US010242691B2

(12) United States Patent
Pak et al.

(10) Patent No.: US 10,242,691 B2
(45) Date of Patent: Mar. 26, 2019

(54) METHOD OF ENHANCING SPEECH USING VARIABLE POWER BUDGET

(71) Applicant: GWANGJU INSTITUTE OF SCIENCE AND TECHNOLOGY, Gwangju (KR)

(72) Inventors: Junhyeong Pak, Gwangju (KR); Jongwon Shin, Gwangju (KR)

(73) Assignee: GWANGJU INSTITUTE OF SCIENCE AND TECHNOLOGY, Gwangju (KR)

( * ) Notice: Subject to any disclaimer, the term of this patent is extended or adjusted under 35 U.S.C. 154(b) by 66 days.

(21) Appl. No.: 15/355,678

(22) Filed: Nov. 18, 2016

(65) Prior Publication Data

US 2017/0140772 A1 May 18, 2017

(30) Foreign Application Priority Data

Nov. 18, 2015 (KR) ..... 10-2015-0161778

(51) Int. Cl.

*G10L 21/0232* (2013.01)
*G10L 21/0316* (2013.01)
*G10L 21/038* (2013.01)
*G10L 25/21* (2013.01)

(52) U.S. Cl.

CPC ..... *G10L 21/0232* (2013.01); *G10L 21/038* (2013.01); *G10L 21/0316* (2013.01); *G10L 25/21* (2013.01)

(58) Field of Classification Search

None

See application file for complete search history.

(56) References Cited

U.S. PATENT DOCUMENTS 6,859,531 B1 * 2/2005 Deisher ..... H04M 9/082 379/406.01
2002/0147585 A1 * 10/2002 Poulsen ..... G10L 19/0212 704/233
2004/0101038 A1 * 5/2004 Etter ..... H04B 1/123 375/222
2005/0147235 A1 * 7/2005 Telukuntla ..... H04M 9/082 379/406.01

(Continued)

OTHER PUBLICATIONS

Sauert et al., "Near End Listening Enhancement Optimized With Respect to Speech Intelligibility Index and Audio Power Limitations", Institute of Communication Systems and Data Processing, EUSIPCO-2010, Aug. 23-27, 2010, pp. 1919-1923, Aalborg, Denmark.

*Primary Examiner* — Neeraj Sharma

(74) *Attorney, Agent, or Firm* — Hauptman Ham, LLP

(57) ABSTRACT

Disclosed herein is a method of enhancing speech. The method includes calculating a far-end speech spectrum by performing fast Fourier transformation of a signal received by a far-end user, calculating a background noise spectrum collected by a microphone provided to a mobile device of a near-end user; calculating a gain from the far-end speech spectrum and the background noise spectrum using a speech intelligibility index-based module, and deriving an enhanced far-end speech spectrum by applying the gain to the far-end speech spectrum, wherein, in calculating a gain using a speech intelligibility index-based module, a power budget used for transmitting and receiving a speech signal is set to vary with the background noise spectrum.

8 Claims, 3 Drawing Sheets

(56) References Cited

U.S. PATENT DOCUMENTS

2008/0312916 A1* 12/2008 Konchitsky ..... G10L 21/0208
704/226
2009/0281800 A1* 11/2009 LeBlanc ..... G10L 21/0208
704/224
2014/0003635 A1* 1/2014 Mohammad ..... G10K 11/16
381/306
2014/0142943 A1* 5/2014 Ishikawa ..... G10L 17/26
704/249
2015/0110282 A1* 4/2015 Sun ..... H04B 3/23
381/66
2015/0126255 A1* 5/2015 Yang ..... G10L 21/0208
455/570
2015/0142426 A1* 5/2015 Song ..... G10L 21/0208
704/226
2015/0249885 A1* 9/2015 Kawabata ..... H04B 3/231
381/66
2016/0309042 A1* 10/2016 Kechichian ..... G10K 11/175

* cited by examiner (PRIOR ART)

METHOD OF ENHANCING SPEECH USING VARIABLE POWER BUDGET

CROSS REFERENCE TO RELATED APPLICATION

This application claims the benefit of Korean Patent Application No. 10-2015-0161778, filed on Nov. 18, 2015, entitled "SPEECH REINFORCEMENT METHOD USING SELECTIVE POWER BUDGET", which is hereby incorporated by reference in its entirety into this application.

BACKGROUND

1. Technical Field

The present invention relates to a method of enhancing speech using a variable power budget in order to overcome a partial masking effect due to near-end background noise.

2. Description of the Related Art

When a user is on the phone or listening to music, noise present at a user side directly reaches ears of a user, and thus deteriorates speech quality of the other party while reducing the amplitude of a speech signal felt by the user. Thus, understandability and intelligibility of speech of the other party are deteriorated and it is more difficult for the user to listen to the speech of the other party as the noise increases.

When a power spectrum of ambient noise cannot be controlled despite being able to be estimated, there is proposed a method of enhancing a speech signal reaching a receiver side. A method of simply increasing overall power of speech is not desirable in consideration of frequency characteristics of noise. In addition, although a method of completely masking noise by a signal in each band by amplifying a frequency component of the signal has been proposed, this method has a problem in that an original sound becomes too louder when noise is severe.

Further, a method of enhancing speech by optimizing a speech intelligibility index has been proposed. The speech intelligibility index for each frequency band is determined through several experiments and is designed to allow clear recognition (intelligibility) of a speech signal. Namely, this method allows a receiver exposed to near-end noise to intelligibly listen to speech by maximizing intelligibility of a far-end signal (signal from a sender side). However, since a limited power budget is used in this method, the method has a limit to actual application.

BRIEF SUMMARY

It is an aspect of the present invention to provide a method of enhancing speech, which prevents speech and acoustic signals from being partially masked by near-end noise based on a method of optimizing a speech intelligibility index of a speech signal reaching a receiver side when near-end noise is present at the receiver side.

In accordance with one aspect of the present invention, a method of enhancing speech includes: calculating a far-end speech spectrum by performing fast Fourier transformation of a signal received by a far-end user; calculating a background noise spectrum collected by a microphone provided to a mobile device of a near-end user; calculating a gain from the far-end speech spectrum and the background noise spectrum using a speech intelligibility index-based module; and deriving an enhanced far-end speech spectrum by applying the gain to the far-end speech spectrum, wherein, in calculating a gain using a speech intelligibility index-based module, a power budget used for transmitting and receiving a speech signal is set to vary with the background noise spectrum.

Calculating a gain from the far-end speech spectrum and the background noise spectrum using a speech intelligibility index-based module may include: calculating a normalization factor for setting a gain of a filter bank to 1, after calculating the background noise spectrum collected by the microphone provided to the mobile device of the near-end user; converting the far-end speech spectrum into an equivalent speech spectrum using the normalization factor; and converting the background noise spectrum into an equivalent noise spectrum using the normalization factor.

The method may further include deriving a masking factor required for calculating a masking spectrum due to noise present at a near-end side, after converting the background noise spectrum into the equivalent noise spectrum.

The method may further include deriving an equivalent masking spectrum with reference to the equivalent noise spectrum and the masking factor.

The method may further include deriving a weight for each frequency band using the far-end speech spectrum and the equivalent masking spectrum after deriving the equivalent masking spectrum, the weight for each frequency band being used as a weight for giving importance to each band in a frequency domain.

In one embodiment, a power budget parameter $\alpha$ for changing the power budget is defined depending upon a level of near-end noise and may be set to increase in an environment in which the near-end noise is greater than the speech signal and to decrease in an environment in which the near-end noise is less than the speech signal.

According to the present invention, with an algorithm according to the method of enhancing speech in which the speech intelligibility index of the speech signal reaching the near-end side is optimized, intelligibility of speech reaching the near-end side is improved when noise present at the near-end side cannot be directly controlled, thereby allowing the intention of the far-end user to be more easily recognized.

BRIEF DESCRIPTION OF THE DRAWINGS

The above and other aspects, features, and advantages of the present invention will become apparent from the detailed description of the following embodiments in conjunction with the accompanying drawings.

DETAILED DESCRIPTION

Hereinafter, embodiments of the present invention will be described in detail with reference to the accompanying drawings. It should be understood that the present invention is not limited to the following embodiments. A description of details of functionalities or configurations known in the art may be omitted for clarity.

Figure 1:
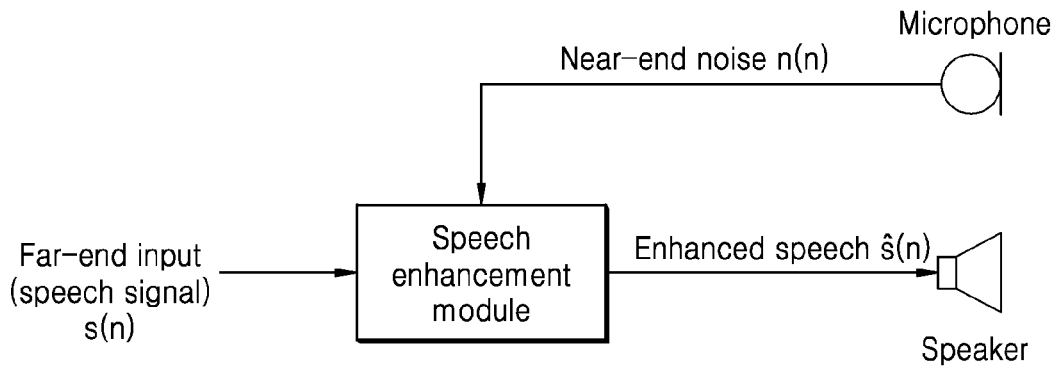
FIG. 1 is a schematic diagram of a communication system using a general method of enhancing speech.

FIG. 1 is a schematic diagram of a communication system using a general method of enhancing speech.

Referring to FIG. 1, it is assumed that a far-end input signal, which is a speech signal generated by a far-end user, is s(n) and a near-end noise signal measured at a microphone provided to a mobile device of a near-end user is n(n). In the following embodiments, a method of enhancing speech in an exemplary environment, in which speech signals are communicated between the near-end and far-end users through a mobile device such as a smartphone, will be described. Hereinafter, the near-end user may be understood as a user sending or receiving speech at a current near position and the far-end user may be understood as a user transmitting speech to and receiving speech from the near-end user while being at a remote position.

It is assumed that a far-end signal is a speech signal sent by the other party speaking with the near-end user on the phone; a near-end signal is a speech signal sent from a current position; near-end noise is background noise present at the current position; and far-end noise is background noise present in an environment of the far-end user.

The far-end input signal and the near-end noise signal are reference signals and are input as an input signal of a speech enhancement module, and ŝ(n), which is an enhanced speech signal having improved intelligibility, is output to a speaker provided to a near-end mobile device through an algorithm for optimizing a speech intelligibility index of a speech signal.

In embodiments of the present invention, a speech enhancement algorithm performed in the speech enhancement module is proposed and intelligibility of a speech signal transferred to the near-end user is further improved through the speech enhancement algorithm, thereby allowing the near-end user to clearly understand the intention of the far-end user.

Figure 2:
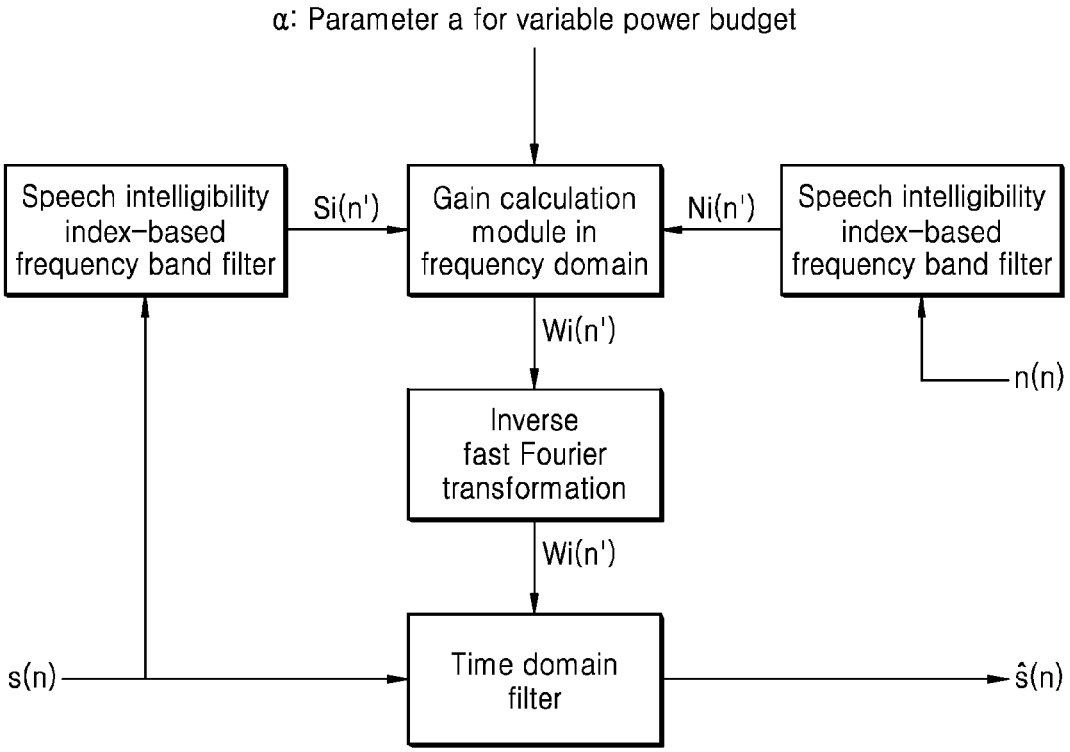
FIG. 2 is a schematic diagram of a speech enhancement system according to one embodiment of the present invention.

FIG. 2 is a schematic diagram of a speech enhancement system according to one embodiment of the present invention.

Referring to FIG. 2, for analysis in time and frequency domains, a far-end speech signal s(n) sent by a far-end user and a near-end noise signal n(n), which is background noise present around a near-end user, pass through a speech intelligibility-based frequency band filter and are converted into Si(n) and Ni(n), respectively. In addition, these values may be processed by a gain calculation module in the frequency domain.

The gain calculation module calculates a weight for each frequency band by calculating an equivalent masking spectrum due to a masking effect of a near-end noise signal and converts the far-end speech signal into an equivalent speech spectrum in order to enhance speech according to a speech intelligibility index. According to the embodiment, calculation of a power budget is performed after calculation of the equivalent speech spectrum. More specifically, a parameter is set such that the power budget may be variably set, and upper and lower limits of the power budget are set, thereby setting the power budget within a specified range.

An optimized equivalent speech spectrum based on a speech intelligibility index is calculated with reference to the set power budget, the weight for each frequency band and the equivalent masking spectrum, and a final time-varying gain is derived. The time-varying gain is multiplied by the equivalent speech spectrum, thereby deriving an enhanced speech spectrum capable of supplementing intelligibility of speech, which is reduced due to background noise. Next, the enhanced speech spectrum is converted into a speech signal corresponding to a time axis, thereby obtaining a final enhanced speech signal.

Figure 3:
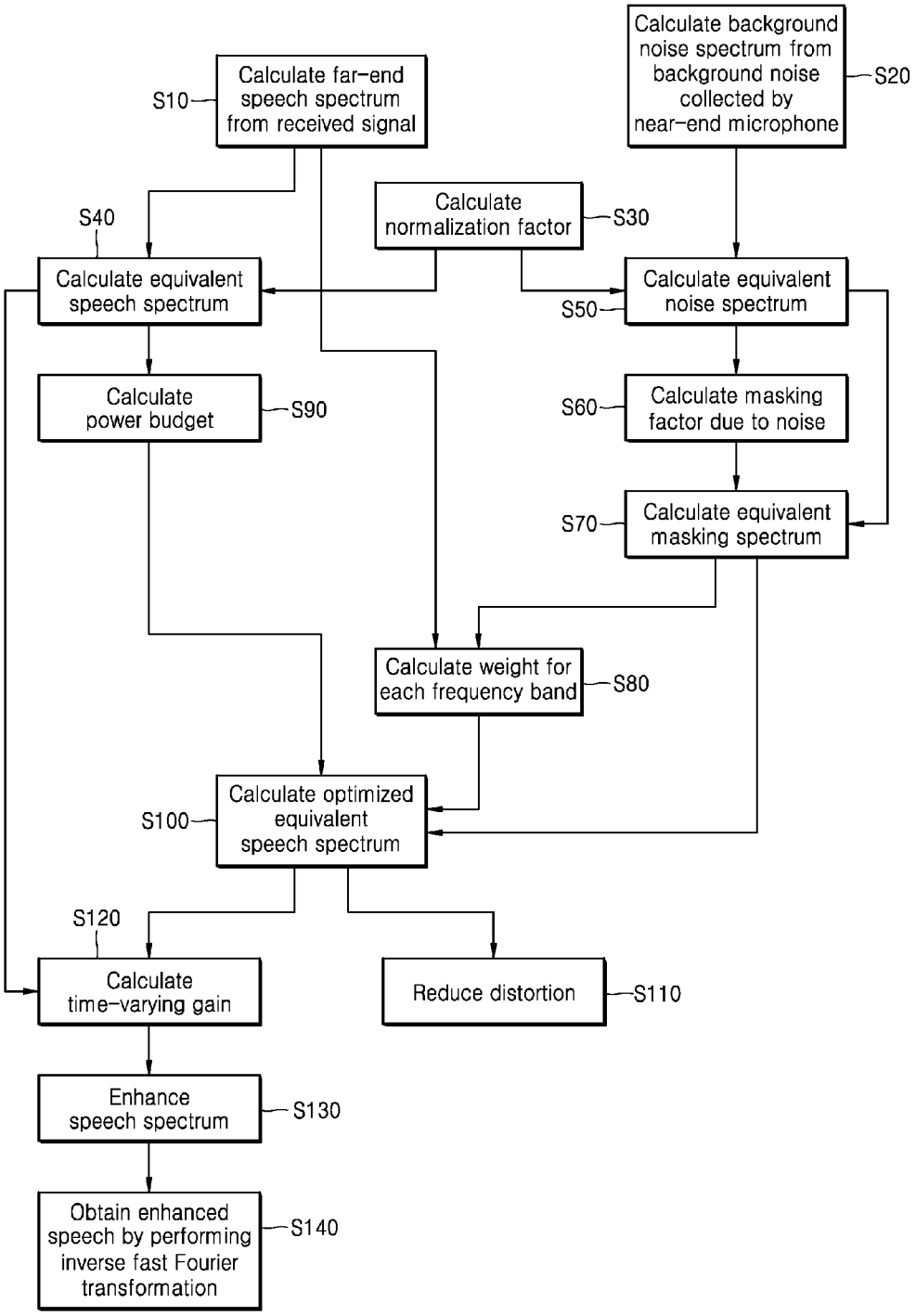
FIG. 3 is a flowchart of a method of enhancing speech according to one embodiment of the present invention.

FIG. 3 is a flowchart of a method of enhancing speech according to an embodiment.

Referring to FIG. 3, in the method of enhancing speech, a far-end speech spectrum from a received signal may be calculating (S10). In operation S10, it is assumed that there is no noise in an environment of a far-end user sending a speech signal to a current user, and a far-end speech spectrum is derived by taking a fast Fourier transform of a far-end speech signal in order to analyze time and frequency of the far-end speech signal.

Next, a background noise spectrum from background noise collected from a microphone provided to a device of a near-end user may be calculated (S20). In operation S20, the background noise spectrum may be derived by taking a fast Fourier transform of the background noise obtained from microphones which mediate a speech signal in near-end and far-end communication systems.

Next, a normalization factor may be calculated (S30). The normalization factor serves to adjust a gain of a filter bank to 1 and may be represented by Equation 1:

$$g_u = \left(\sqrt{\sum_{n=0}^{L} h^2(n)}\right)^{-1}$$

wherein n is a sample index, L is a window length, and h is a window function.

Next, an equivalent speech spectrum may be calculated (S40). A speech intelligibility index (SII) is obtained by the equivalent speech spectrum (Ei(K)) and an equivalent noise spectrum (Ni(k)). Thus, in a method of enhancing speech based on SII, the far-end speech spectrum obtained in operation S10 needs to be converted into the equivalent speech spectrum, as in the method according to the embodiment. The far-end speech spectrum (Φss,i(k)) may be converted into the equivalent speech spectrum (Ei(K)) with reference to the normalization factor ($g_u$) and the equivalent speech spectrum may be represented by Equation 2:

$$E_i(k) = 10\log\left\{\frac{g_u^2\Phi_{ss,i}(k)}{\Delta f_i}\right\}$$

wherein Φss,i(k) is the far-end speech spectrum, $\Delta f_i$ is a frequency bandwidth, k is a sample index, and i is a band number.

Next, the equivalent noise spectrum may be calculated (S50). As in S40, the speech intelligibility index (SII) is obtained by the equivalent speech spectrum (Ei(K)) and the equivalent noise spectrum (Ni(k)). Thus, in a method of enhancing speech based on SII, the near-end noise spectrum obtained in operation S20 needs to be converted into the equivalent noise spectrum, as in the method according to the embodiment.

The near-end noise spectrum may be converted into the equivalent noise spectrum (Ni(k)) with reference to the normalization factor ($g_u$) derived in operation S20, and the equivalent noise spectrum may be represented by Equation 3:

$$N_i(k) = 10\log\left\{\frac{g_u^2\Phi_{nn,i}(k)}{\Delta f_i}\right\}$$

wherein Φnn,i(k) is a far-end noise spectrum, $\Delta f_i$ is the frequency bandwidth, k is the sample index, and i is the band number.

Next, operation S60 of calculating a masking factor due to noise may be performed. The masking factor is a variable required for calculating an equivalent masking spectrum, and may be represented by $C_i=-80\text{ dB}+0.6[N_i+10\log(\Delta f_i)]$.

Next, the equivalent masking spectrum may be calculated (S70). The equivalent masking spectrum is a variable required for obtaining a weight for each frequency band, and has information on masking due to noise, the weight for each frequency band being needed to calculate an optimized equivalent speech spectrum. The equivalent masking spectrum may be derived with reference to the equivalent noise spectrum, which is derived in S50, and the masking factor, which is derived in S60. The equivalent masking spectrum may be represented by Equation 4:

$$D_i = 10\log\left\{10^{N_i/10} + \sum_{\lambda=1}^{i-1} 10^{[N_\lambda + 3.32C_\lambda \log(f_i/h_\lambda)]/10}\right\}$$

Next, the weight for each frequency band may be calculated (S80). The weight for each frequency band is a variable required for obtaining the optimized equivalent speech spectrum, and may be utilized as a weight for giving importance to each band in the frequency domain. The weight for each frequency band may be calculated with reference to an importance function for each frequency band, a standard speech spectrum, and the equivalent masking spectrum. The importance function for each frequency band and the standard speech spectrum are obtained with reference to published ANSI S3.5-1997, and the weight for each frequency band may be represented by Equation 5:

$$\gamma_i = I_i \times \min\left\{1 - \frac{D_i + 15\text{ dB} - U_i - 10\text{ dB}}{160\text{ dB}}, 1\right\}$$

wherein $\gamma_i$ is the weight for each frequency band, $I_i$ is the importance function for each frequency band, and $U_i$ is the standard speech spectrum.

Next, a variable power budget may be calculated (S90). In the method according to the embodiment, instead of transmitting and receiving a speech signal using a limited power budget like in a typical method, a variable parameter α for variably adjusting the power budget is introduced such that a communication system can be automatically adapted to near-end noise depending upon a level of the near-end noise.

A representative indicator capable of measuring the level of the near-end noise is signal-to-noise ratio (SNR). The parameter α may be set to increase in an environment, in which the near-end noise is greater than the speech signal, and to decrease in an environment, in which the near-end noise is less than the speech signal. The variable parameter may flexibly vary with the amplitude of noise.

In the method according to the embodiment, although the power budget is variably applied to transmission and reception of the speech signal, a maximum value of the variable parameter α needs to be set in order to prevent indiscreet power consumption of a mobile device, depending upon setting of a user. That is, a degree of enhancement of far-end speech needs to be controlled to a certain level. In addition, a minimum value of the variable parameter α may be set to 1 by taking into account signal-to-noise ratio of the far-end speech. The variable power budget is represented by Equation 6:

$$P_{ref}(k) = \alpha \sum_{i=1}^{i_{max}} \Delta f_i \times 10^{E_i(k)/10}$$

wherein α is the variable parameter, and $i_{max}$ is a maximum value of a band index.

Next, the optimized equivalent speech spectrum may be calculated (S100). When the power budget is determined by the variable parameter α that is set in S90, the equivalent speech spectrum, in which intelligibility of a far-end signal is partially improved, may be calculated with reference to the equivalent masking spectrum and the weight for each frequency band, according to the power budget.

The equivalent speech spectrum may be initialized and repeatedly optimized by repetitive operation according to conditions. In the method according to the embodiment, when the equivalent speech spectrum is greater than a value obtained by adding 15 dB to the equivalent masking spectrum, the value obtained by adding 15 dB to the equivalent masking spectrum is set as the optimized equivalent speech spectrum. In addition, when the equivalent speech spectrum is not greater than the value obtained by adding 15 dB to the equivalent masking spectrum, the equivalent speech spectrum is calculated using the previously set power budget.

Next, reduction of distortion may be performed (S110). In the method according to the embodiment, the equivalent speech spectrum may be optimized within a given variable power budget and the remaining power budget may be used to reduce distortion in order to reduce unnaturalness of speech, which can occur after intelligibility optimization-based speech enhancement. In operation S110, the optimized equivalent speech spectrum may refer to the standard speech spectrum in order to calculate the equivalent speech spectrum having reduced distortion.

Next, a time-varying gain may be calculated (S120). The time-varying gain, which is strength of signal power changed using an amplifier, may be calculated by comparing the optimized equivalent speech spectrum after determination of the power budget with the equivalent speech spectrum before determination of the power budget.

Next, a speech spectrum may be enhanced (S130). The time-varying gain obtained in S120 is a value derived by a changed power budget, and the far-end speech spectrum is changed into an enhanced far-end speech spectrum by multiplying the far-end speech spectrum by the time-varying gain.

Next, enhanced speech may be obtained by performing inverse fast Fourier transformation (S140). In operations S10 to S30, signals including a spectrum have been derived by performing fast Fourier transformation of near-end and far-end signals, for time and frequency analysis. To convert these signals into the original signals, inverse fast Fourier transformation may be applied to the enhanced far-end speech spectrum, thereby obtaining an enhanced speech signal.

In the method of enhancing speech according to the embodiment, although background noise is present at a near-end side, the power budget may be set such that influence by the near-end noise is minimized through the speech enhancement algorithm as set forth above, thereby enhancing intelligibility of the far-end speech signal. Therefore, the near-end user can more easily recognize the speech and intention of the far-end user.

Although the present invention has been described with reference to some embodiments in conjunction with the accompanying drawings, it should be understood that the foregoing embodiments are provided for illustration only and are not to be construed in any way as limiting the present invention, and that various modifications, changes, alterations, and equivalent embodiments can be made by those skilled in the art without departing from the spirit and scope of the invention. Therefore, the scope of the invention should be limited only by the accompanying claims and equivalents thereof.

What is claimed is:

1. A method of enhancing speech in mobile device of a near-end user, comprising:

calculating a far-end speech spectrum by performing fast Fourier transformation of a signal received by a far-end user;

calculating a background noise spectrum collected by a microphone provided to the mobile device of the near-end user;

calculating a gain from the far-end speech spectrum and the background noise spectrum using a speech intelligibility index-based module;

deriving an enhanced far-end speech spectrum by applying the gain to the far-end speech spectrum; and wherein, in calculating a gain using a speech intelligibility index-based module, a power budget used for transmitting and receiving a speech signal is set to vary with the background noise spectrum, wherein a power budget parameter $\alpha$ for changing the power budget is defined depending upon a level of near-end noise, wherein the power budget parameter $\alpha$ increases when the level of the near-end noise increases, wherein the power budget parameter $\alpha$ decreases when the level of the near-end noise decreases, wherein the power budget parameter a has an upper limit of a predetermined value and a lower limit of 1, to set the power budget within a specified range, converting the enhanced far-end speech spectrum to an enhanced speech signal; and playing back the enhanced speech signal using a speaker provided to the mobile device of the near-end user.

2. The method of enhancing speech according to claim 1, wherein calculating a gain from the far-end speech spectrum and the background noise spectrum using a speech intelligibility index-based module comprises:

calculating a normalization factor for setting a gain of a filter bank to 1, after calculating the background noise spectrum collected by the microphone provided to the mobile device of the near-end user;

converting the far-end speech spectrum into an equivalent speech spectrum using the normalization factor; and converting the background noise spectrum into an equivalent noise spectrum using the normalization factor.

3. The method of enhancing speech according to claim 2, further comprising:

deriving a masking factor required for calculating a masking spectrum due to noise present at a near-end side, after converting the background noise spectrum into the equivalent noise spectrum.

4. The method of enhancing speech according to claim 3, further comprising:

deriving an equivalent masking spectrum with reference to the equivalent noise spectrum and the masking factor.

5. The method of enhancing speech according to claim 4, further comprising:

deriving a weight for each frequency band using the far-end speech spectrum and the equivalent masking spectrum after deriving the equivalent masking spectrum, the weight for each frequency band being used as a weight for giving importance to each band in a frequency domain.

6. The method of enhancing speech according to claim 5, further comprising:

deriving the equivalent speech spectrum, in which intelligibility of the far-end speech signal is optimized, with reference to the equivalent masking spectrum, the weight for each frequency band and the far-end speech signal, according to the power budget, after the power budget is set.

7. The method of enhancing speech according to claim 6, further comprising:

calculating a time-varying gain by comparing the optimized equivalent speech spectrum with the equivalent speech spectrum before taking into account the power budget, after deriving the equivalent speech spectrum, in which intelligibility of the far-end speech signal is optimized.

8. The method of enhancing speech according to claim 7, wherein the speech signal transferred from a far-end side is enhanced by multiplying the far-end speech spectrum by the time-varying gain.

* * * * *